US006796298B1

(12) United States Patent
Kiker

(10) Patent No.: US 6,796,298 B1
(45) Date of Patent: Sep. 28, 2004

(54) IGNITION SPARK ENHANCING DEVICE

(76) Inventor: Harvey G. Kiker, 3601 E. Ramsey Way, Avon Park, FL (US) 33825

( * ) Notice: Subject to any disclaimer, the term of this patent is extended or adjusted under 35 U.S.C. 154(b) by 47 days.

(21) Appl. No.: 10/393,693

(22) Filed: Mar. 20, 2003

Related U.S. Application Data

(63) Continuation-in-part of application No. 10/353,329, filed on Jan. 29, 2003.

(51) Int. Cl.[7] ..... F02P 3/02; F02P 15/00
(52) U.S. Cl. ..... 123/620; 123/143 C
(58) Field of Search ..... 123/620, 143 C, 123/536, 647, 633, 169 PA, 169 PH; 439/125, 126, 127, 502

(56) References Cited

U.S. PATENT DOCUMENTS 3,939,814 A * 2/1976 Bergstresser ..... 123/620
4,193,651 A * 3/1980 Hays ..... 439/502
4,502,025 A * 2/1985 Carl et al. ..... 333/24 R
4,596,222 A * 6/1986 Ortiz ..... 123/620
4,774,914 A * 10/1988 Ward ..... 123/620
4,784,100 A 11/1988 Huan
4,944,280 A 7/1990 Washington
5,109,828 A 5/1992 Tagami et al.
6,089,214 A * 7/2000 Anderson ..... 123/620
6,328,010 B1 12/2001 Thurman
6,374,816 B1 * 4/2002 Funk et al. ..... 123/169 PH
6,668,810 B1 * 12/2003 St. John et al. ..... 123/634
6,736,119 B1 * 5/2004 Kiker ..... 123/620

* cited by examiner

*Primary Examiner*—Mahmoud Gimie
*Assistant Examiner*—Arnold Castro
(74) *Attorney, Agent, or Firm*—Charles J. Prescott

(57) ABSTRACT

An ignition spark enhancing device and spark plug wire disposed in or establishing the electrical path between a spark source and a spark plug of an internal combustion engine. The device includes one or more coils of conductive hollow tubing formed from a length of conductive tubing and having ends each configured for connection to the spark plug wire of the device or to a spark plug. The tubing is preferably copper and may also be aluminum or other conductive material and is also preferably used to form each spark plug wire as well for durability. At least five complete loops or turns wound concentrically or in helix fashion are preferred. The device is also preferably coated with a non-conductive material to reduce any risk of electrical shock or short circuit.

17 Claims, 2 Drawing Sheets

IGNITION SPARK ENHANCING DEVICE

CROSS-REFERENCE TO RELATED APPLICATIONS

This is a continuation-in-part of application Ser. No. 10/353,329 filed Jan. 29, 2003.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for increasing internal combustion engine efficiency, economy and performance, and more particularly to a coil wound conductive device formed of highly conductive tubing positioned in the pathway between the spark source and each spark plug of such engines.

2. Description of Related Art

In an internal combustion engine using a spark plug to ignite combustion, the intensity or voltage of the spark produced across the gap of the spark plug has a great deal to do with the efficiency, economy, power output and acceleration to full power of the internal combustion engine. A great deal of technology has therefore developed to enhance this functional aspect of the operation of the engine.

A number of prior art devices are known which have attempted to provide a "hotter" spark to the spark plugs to achieve the enhanced performance of the engine. One such prior patented device is disclosed in U.S. Pat. No. 4,944,280 invented by Washington which teaches a separated circuit or spark gap producing device that introduces an auxiliary gap into the electrical path between the spark source and the spark plug. This area of technology directed to producing a capacitive-type spark gap for enhanced voltage buildup before current is discharged and reaches the spark plug is well known. However, Washington developed an improved apparatus which accurately controls and varies this spark gap to achieve individual and selective adjustment of the size of the gap to achieve even more optimal performance from the engine.

Tagami in U.S. Pat. No. 5,109,828 teaches an apparatus for supplying high voltage to the spark plug via a spark coil and a distributor plate of unitary construction.

In U.S. Pat. No. 6,328,010, Thurman teaches a spark plug wire harness assembly having a substantially rigid body, plug wire mounting posts, and output terminals. The conductors are embedded within the rigid body.

An electrically controlled engine ignition system for increased power and economy was invented by Huan and disclosed in U.S. Pat. No. 4,784,100. This disclosure is of an ignition system which is capable of controllably adjusting the ignition spark and timing in accordance with conditions imposed on the automobile by road and driver habit.

The present invention discloses a very simple, economical to manufacture and easy to install or incorporate into an originally manufactured spark plug wire extending from a spark source to the spark plug. The device, which is added to the spark plug wire itself in series therealong or at the end of the spark plug wire immediately adjacent to the spark plug, is formed of a length of highly conductive tubing, preferably copper tubing, having one or more loops of the coiled tubing formed therein. This improvement has been shown to result in increased power, acceleration and economy. The preferred embodiment of the invention replaces the conventional spark plug wire in its entirety and replaces it preferably with a continuous length of copper tubing sized in inside and outside diameter to be substantially similar to that of the spark enhancing device itself. Alternately, the length of spark plug wire may be replaced by heavier current and voltage carrying spark plug wire formed of strands of solid copper wire encased within a shielding jacket or casing therefor.

BRIEF SUMMARY OF THE INVENTION

This invention is directed to an ignition spark enhancing device which establishes the electrical path between a spark source and a spark plug of an internal combustion engine. The device includes one or more coils or turns of conductive hollow tubing having ends configured for connection to a new replacement spark plug wire and to a spark plug, respectively. The tubing is preferably copper and may also be aluminum or other conductive material. At least five complete loops or turns wound concentrically or in helix form are preferred. The device and its new spark plug wire are also preferably coated with a non-conductive material to reduce any risk of electrical shock or short circuit.

It is therefore an object of this invention to provide a spark enhancing device for the ignition system of an internal combustion engine.

Still another object of this invention is to provide a simple addition to each of the spark plug wires which has shown measurable improvement upon the performance of an internal combustion engine.

Yet another object of this invention is to provide an improved spark plug wire which conveys higher ignition voltage from an ignition source to the spark plug of an internal combustion engine.

Still another object of this invention is to provide an improved ignition system spark voltage at the spark plug without substantial radio interference produced therefrom.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
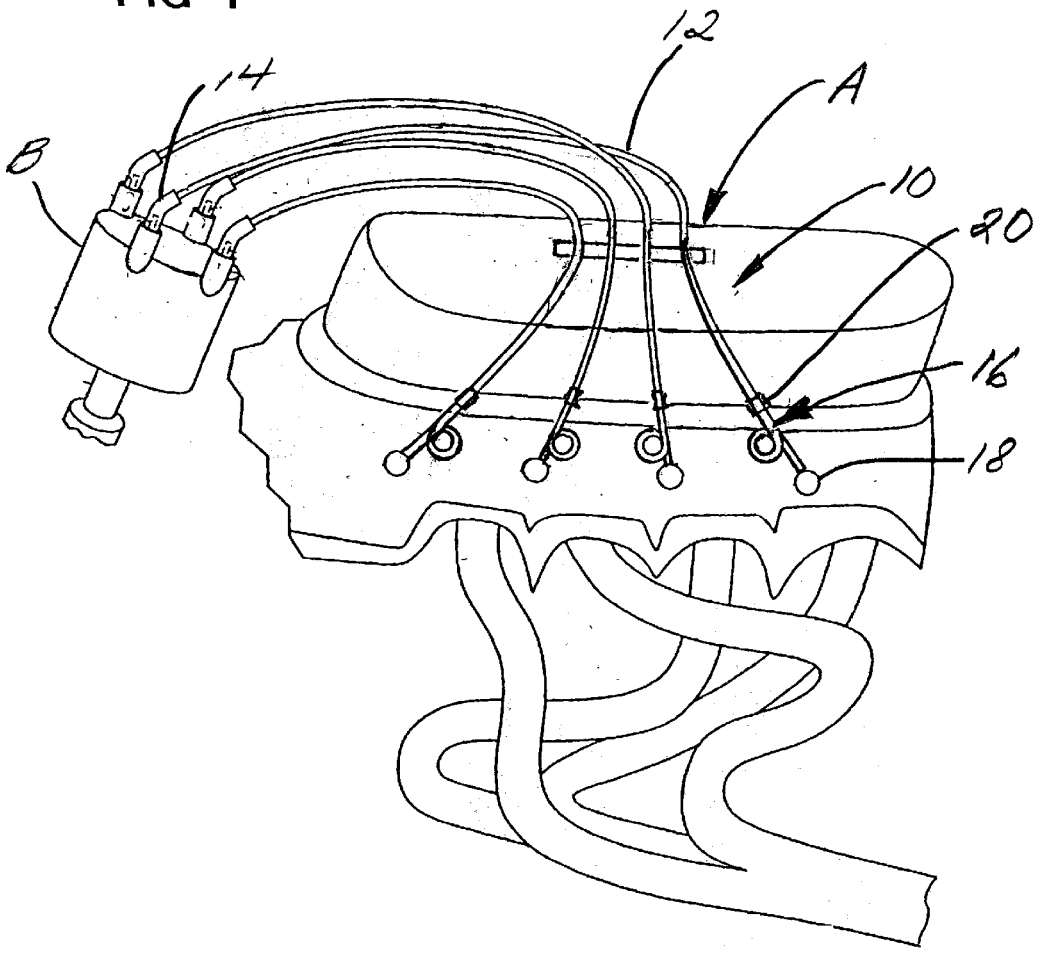
FIG. 1 is a perspective schematic view of the invention including new spark plug wires for an internal combustion engine.
Figure 2:
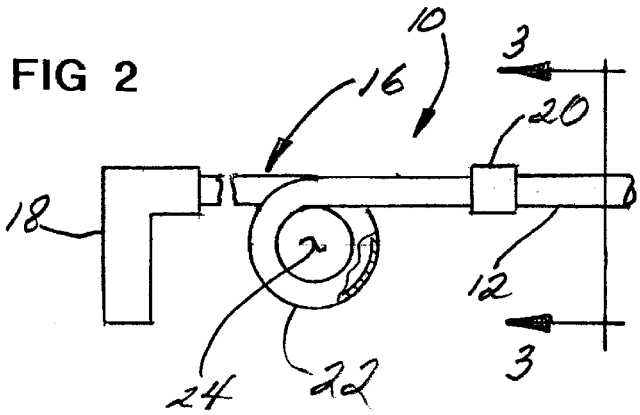
FIG. 2 is a side elevation view of the spark enhancing device of the invention shown in FIG. 1.
Figure 3:
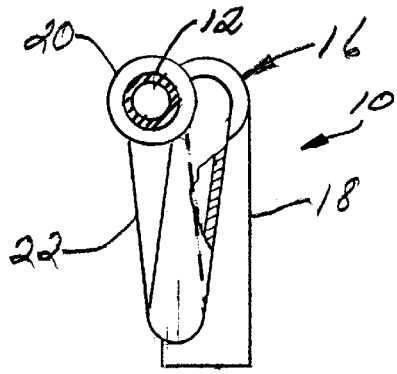
FIG. 3 is a section view in the direction of arrows 3—3 in FIG. 2.

Referring now to the drawings, the invention, in one embodiment thereof, is shown generally at numeral 10 in FIGS. 1 to 3 and includes a spark enhancing device 16 interconnected in series along the length of each new, improved spark plug wire 12, each of which extend from an outlet port 14 of a spark source B to a spark plug cap 18 attached to one of the spark plugs (not shown) of an internal combustion engine A. The spark source B is typically in the form of a distributor having a spark coil for spark voltage buildup and a distributor plate which sequentially distributes spark voltage and current to each of the new spark plug wires 12 for sequential firing of each of the spark plugs in a predetermined sequence.

This embodiment of the spark enhancing device 16 includes a coiled length of copper tubing having a single helix wound loop 22 formed centrally therealong. One end 20 of the device 16 is interconnected (or interconnectable) to one end of each new spark plug wire 12 while the other end 18 of the device 16 is structured as a spark plug cap which tightly fits over the exposed end of the spark plug, making electrical contact with the metallic spark plug tip (not shown).

In this embodiment 16, the sizing of the copper tubing has been selected as having an outside diameter of ⅛" (O.D.) an inside diameter (I.D.) of 1/16" and a wall thickness of approximately 1/32". The tubing is wrapped around a shaft having a diameter of 24 of ¼" in helix fashion. Because conventional carbon filled or impregnated spark plug wires have been found to be short lived when used in combination with the spark enhancing device 16, a new spark plug wire 12 preferably formed of the same copper tubing as that of the device 16 itself is provided. Apparently the heavier voltage and current imposed on the conventional spark plug wiring cause it to rapidly fail. Use of a continuous length of copper tubing to replace the conventional spark plug wire eliminates this problem and, in fact, appears to enhance overall performance and economy still further as briefly described in Example K.

Figure 4:
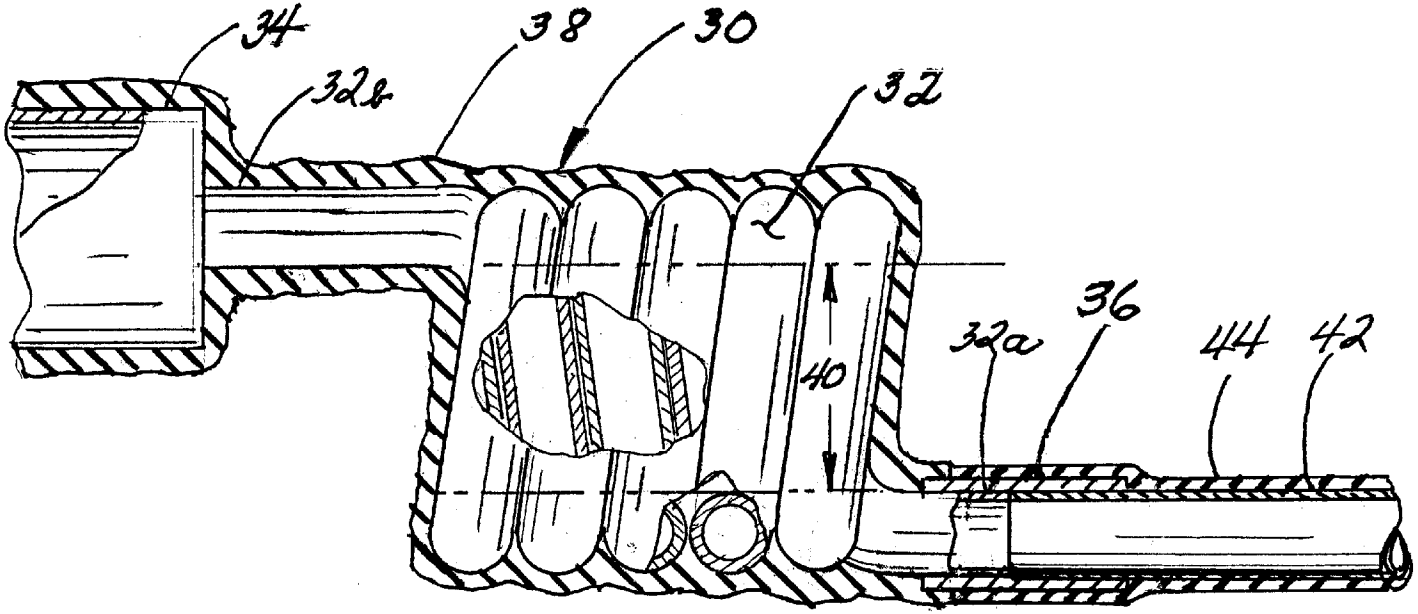
FIG. 4 is a side elevation view in partial section of a preferred embodiment of the spark enhancing device.

Referring now to FIG. 4, the preferred embodiment of the spark enhancing device of the invention is there shown at numeral 30. This embodiment 30 is also formed of a single length of copper tubing having an outside diameter (O.D.) of ⅛", an inside diameter (I.D.) of 1/16" and a wall thickness of 1/32". This embodiment 30 includes five loops or turns 32 of the copper tubing, these loops 32 being formed about a mandrel or shaft having an outside diameter of ¼" as shown at numeral 40.

One end 32*b* of the device 30 is structured at 34 as a spark plug cap for direct interconnection onto the exposed end of a spark plug. The other end 32*a* of the device 30 is connected or made connectable by a metallic copper collar 36 to one end of a copper tube configured spark plug wire 42. This spark plug wire 42 is formed of the same tubing size and material as that of the multi-coils 32. As previously discussed, the overall durability of this form of spark plug wire 42 is greatly enhanced as the entire ignition system delivers substantially higher voltage to each spark plug and has been shown to be detrimental to a conventional carbon filled spark plug wire. A tubular insulating layer 44 extends along the entire length of the copper tubular spark plug wire 44 for electrical isolation thereof.

Figure 4A:
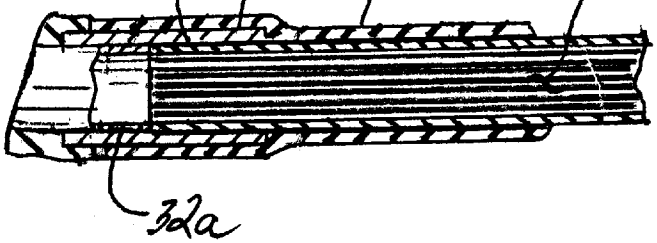
FIG. 4A is a side elevation view of an alternate embodiment of one end of FIG. 4.

Referring now to FIG. 4A, an alternate embodiment of the spark plug wire is there shown at 48 in the form of strands of solid copper wire bundled together within a non-conductive jacket 46. This spark plug wire 48 abuts against one end 32*a* of the device 30, the two being joined in end-to-end fashion as shown by a conductive collar 36 and an insulating tubular casing or sheath member 44 which is shrink wrapped tightly therearound.

Performance Results

Several informal tests were conducted to verify the observed validity of the performance enhancing aspects of the invention. These are shown in the example herebelow.

EXAMPLE A

A 2001 Suzuki RM 250 dirt bike was initially tested utilizing the factory ignition system. The top speed was measured at 60 to 65 mph achieved from a standing stop over a distance of 660 feet in approximately 10 seconds. The test rider and owner of the dirt bike provided a subjective evaluation of the bike as having a great deal of vibration which was very tiring so that he was unable to ride the bike for long periods of time. The test driver/owner also observed that the "power band" is present only for about the first ten feet in each of the gears of the manual transmission shift pattern.

Test Number 1

A device formed in accordance with the present invention as described in FIG. 4 except for the coil 32 being formed of solid copper wire and using the existing spark plug wire was installed into the spark plug wires of the Suzuki engine. Although the "power band" seemed to last for up to thirty feet at the beginning of each gear shift, the dirt bike achieved a speed of 63 miles an hour, but accomplished this in excess of 10 seconds. It was determined from this test that a coiled solid copper wire device did not provide sufficient enhancing performance to satisfy applicant.

Test Number 2

A hollow copper tubing device formed in accordance with FIG. 4 and the description therewith was then installed into the existing spark plug wires of the device and tested. The "power band" stayed in or lasted for approximately thirty feet and the dirt bike achieved a top speed of 73 mph or an increase of approximately 15 to 20%. The time to achieve that top speed was reduced to 9.0 seconds. The rider/owner observed that the vibration from the engine had been substantially reduced and that takeoff power and torque was substantially increased.

Test Number 3

Without the rider/owner's knowledge, a "dummy" device was installed. The maximum speed achieved was 66 mph over a time of 10.25 seconds. The rider/owner observed far less power and more vibration and, when he realized by the lack of performance that the device had been removed, complained for it to be reinstalled.

EXAMPLE B

A 1986 Honda "Big Red" three-wheeler having a 250 cc engine was also tested.

Test Number 1

With the standard ignition system, this three-wheeler achieved a top speed of 42 mph. Over a marked distance of 270' on a blacktop road, the factory ignition setup achieved 29 mph in 10.25 seconds. The rider observed a great deal of vibration.

Test Number 2

A solid copper device formed of solid wire in accordance with the general description as in FIG. 4 was then tested. Due to excessive vibration, top speed could not be determined. However, over the marked distance of 270', the three-wheeler achieved a top speed of 29 mph in 10.25 seconds, exactly the same as the factory ignition system achieved.

Test Number 3

Utilizing a device formed of hollow copper wire as described in FIG. 4 except using the existing spark plug wire, a top speed of 52 mph was achieved. Over the distance of 270', the three-wheeler achieved a top speed of 34 mph in 8.2 seconds, an increase in speed of approximately 17% and a decrease in time to achieve that speed of approximately 20%. The maximum or top speed achieved was 52 mph for a substantial increase of approximately 24%. The rider also observed a substantial decrease in engine vibration and found the three-wheeler much easier to handle as a result thereof.

EXAMPLE C

A 1980 Z-28 Camaro having a 350 cu. in. engine was also tested.

Test Number 1

Without the device and utilizing factory ignition, the vehicle achieved a speed of 60 mph from a standstill in approximately 8 seconds.

Test Number 2

Utilizing the device formed of hollow copper wire as described in FIG. 4 installed onto each of the existing spark plug wires, the vehicle achieved a 0 to 60 speed in approximately 7½ seconds, a decrease in time to achieve that speed of 60 mph of approximately 6%.

Economy

The economy of this vehicle was also evaluated on a cursory basis. After the vehicle had been driven and tested with the device 30 installed into each of the existing spark plug wires and then removed, economy began to noticeably decrease after approximately 100 miles from the original economy of 20.5 mpg down to approximately 17.5 mpg. The device 30 was then reinstalled into each of the spark plug wires, the 0 to 60 speed performance was regained, and the mileage increased back up to approximately 20.5 mpg for an increase of approximately 17%.

EXAMPLE D

A '96 Vermeer stump grinding machine having a 60 hp air-cooled engine used commercially by applicant was also evaluated.

Test Number 1

To cut a pine stump 2" above the ground and 24" in diameter cut down to 6" below grade level would normally take approximately 10 minutes.

Test Number 2

Utilizing the device 30 as shown in FIG. 4 installed into the existing spark plug wires for each spark plug of the stump machine, the time to perform the same stump-grinding operation was reduced to five minutes. Applicant also observed that the engine ran smoother and could take deeper bites for each pass without excessive engine lugging. A further obvious benefit utilizing this device based upon the time reduction for performing the stump-grinding operation was that the fuel consumption was reduced by approximately 50% as well.

EXAMPLE E

A 1989 Ford 150 pickup truck having a six cylinder engine was also tested for economy only.

Test Number 1

Utilizing the factory ignition system, the pickup truck typically achieved 12 mpg in city traffic.

Test Number 2

Utilizing the device 30 as shown in FIG. 4 installed into each existing spark plug wire, the economy increased to approximately 17.6 mpg, about a 45% mileage increase.

EXAMPLE F

A 1993 Honda Passport having a 70 cc engine was also evaluated.

Test Number 1

Utilizing the factory ignition, the top speed achieved by this vehicle was 40 mph.

Test Number 2

Utilizing the device shown in FIG. 4 and the existing spark plug wires, the vehicle top speed increased to 45 mph, an improvement of approximately 12½%.

EXAMPLE G

A HUSKY 6.4 mulcher was also tested. This mulcher has a double cutting feature wherein one side is utilized for small limbs and branches while the other side is used for leaves and twigs.

Test Number 1

Utilizing the conventional ignition system for this mulcher, only branches and limbs up to 1½" to 2" in diameter could be handled on the first side of the mulcher.

Test Number 2

After installing the invention in the form shown in FIG. 4 at numeral 30 into the existing spark plug wiring, the mulcher was able to chip limbs up to 3" in diameter. The owner of this mulcher indicated that the mulcher was never able to chop limbs that large in the past.

EXAMPLE H

A 2001 TORO Powerhouse Dingo having a 20 hp engine was also tested.

Test Number 1

Utilizing the stump grinder attachment for the Dingo, with the conventional ignition system, a 15" stump normally requires approximately 15 minutes to cut. The Dingo also achieves a top speed of 3 mph.

Test Number 2

Utilizing the present invention installed along the conventional spark plug wire, the top speed of the Dingo increased to 5 mph and, with the stump grinder attachment, a 15" stump was cut in approximately 10 minutes, a 33% reduction in time for cutting and a 67% increase in top speed.

EXAMPLE I

A 1986 Toyota Tacoma having a four cylinder engine utilized as a mail delivery vehicle was also tested for economy.

Test Number 1

Using the conventional factory ignition system, the Tacoma will typically run approximately 2½ days on a single tank of gas.

Test Number 2

With the present invention in the form shown in FIG. 4 installed along each of the existing spark plug wires, the Tacoma will now run 3½ days on a single tank of gas of the same quantity for an increase of approximately 40% in running time under the same conditions of mail delivery.

EXAMPLE J

An ECHO 3000 12" chain saw was also tested for performance.

Test Number 1

Utilizing the factory ignition system, a cut traversely through a 12" diameter pine log took approximately 30 seconds.

Test Number 2

With the device as shown in FIG. 4 at numeral 30 installed into the existing spark plug wire, the same cut through a 12"

diameter pine log took only 25 seconds due to the fact this chainsaw performed having higher lugging power with much less vibration representing a service time decrease of approximately 17%.

EXAMPLE K

A 1992 Oldsmobile Delta 88 powered with a 3.800 C.I.D. V-6 engine was next tested for economy.

Test Number 1

Utilizing the factory ignition system, this vehicle averaged 24 mpg at highway speeds averaging 65 mph.

Test Number 2

Utilizing the device as shown in FIG. 4 at numeral 30 installed into the existing spark plug wiring, this vehicle increased in overall economy to approximately 26 mpg. However, after approximately 300 miles of driving, the existing factory-installed spark plug wires failed as evidenced by poor engine operation and signs of having been overheated and physically burned or charred.

Test Number 3

The device as shown in FIG. 4 at numeral 30 was installed into the vehicle utilizing new spark plug wires 42 extending from the distributor to the device 30 and being formed of copper tubing as described with respect to FIG. 4. This vehicle so equipped increased in overall economy to approximately 30 mpg or about 25% in a driving schedule that included both highway speeds of 65 mph and some stop and go driving over a total mileage of 440 miles. No damage to any aspect of the ignition or engine was detected during this extended test.

Theory of Operation

Applicant can only speculate as to the theory of the enhanced performance achieved by internal combustion engines equipped with the present invention installed into each spark plug wire thereof. The preferred positioning of the device is approximately 2 to 4 inches from the spark plug along the length of the spark plug wire. However, as previously described, the positioning of the device may be anywhere along the length of the spark plug wire, including at the distal end thereof and forming the spark plug cap as well.

Utilizing a sensitive ohm meter, some insight into the theory of operation may be gained. Consistently, utilizing the hollow copper tubing to form the device, the resistance in ohms of the entire spark plug wire or simply a length of copper tubing in straight form versus being coiled into successive loops shows significant changes in measured resistance. That is to say that, when the device is installed into the length of a spark plug wire, the overall resistance between the source of the spark and the spark plug cap was reduced measurably from 13.1 ohms down to 1.9 ohms according to the meter utilized.

This significant decrease in resistance would appear to be at least one basis for explaining why the present invention produces more power, acceleration and economy from virtually all spark plug ignited internal combustion engines tested by applicant to evaluate the efficacy of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An ignition spark enhancing apparatus disposed in the electrical path between a spark source and a spark plug of an internal combustion engine comprising:

a spark enhancing device including a coil of conductive hollow tubing having at least one complete loop formed in said coil and having a first end thereof configured for connection to a spark plug;

a length of electrically shielded spark plug wire formed of conductive copper or aluminum being connectable to the spark source at one end thereof and to a second end of said coil.

2. An ignition spark enhancing device as set forth in claim 1, wherein:

said coil has five (5) complete loops.

3. An ignition spark enhancing device as set forth in claim 1, wherein:

said coil has an inside diameter (I.D.) of at least about 1/6" and an outside diameter (O.D.) of up to about 1/2" and a wall thickness of about 1/32".

4. An ignition spark enhancing device as set forth in claim 1, wherein:

said device is substantially coated with a non-conductive material.

5. An ignition spark enhancing device as set forth in claim 4, wherein:

said loop has an inside diameter (I.D.) of in the range of 1/8" to 5".

6. An ignition spark enhancing device connected or connectable in the electrical path between a spark source and a spark plug of an internal combustion engine comprising:

a length of high conductivity hollow tubing formed as a coil having a plurality of substantially concentric loops arranged in closely spaced helix fashion and positioned adjacent a first end thereof;

said first end connected to, or configured for connection to the spark plug while the other said end is connected to, or configured for connection to, the spark source.

7. An ignition spark enhancing device as set forth in claim 6, wherein:

said tubing is copper or aluminum.

8. An ignition spark enhancing device as set forth in claim 6, wherein:

said tubing has five (5) complete loops.

9. An ignition spark enhancing device as set forth in claim 6, wherein:

said tubing has an inside diameter (I.D.) of at least about 1/6" and an outside diameter (O.D.) of at least about 1/2" and a wall thickness of about 1/32".

10. An ignition spark enhancing device as set forth in claim 6, wherein:

said device is substantially coated with a non-conductive material.

11. An ignition spark enhancing device as set forth in claim 9, wherein:

each said loop has an inside diameter (I.D.) of in the range of 1/8" to 5".

12. In a spark ignition system which establishes an electrical path between a spark source and a spark plug of an internal combustion engine, the improvement comprising:

a spark enhancing device formed as a coil of conductive hollow tubing having a plurality of complete loops formed adjacent to or at a first end thereof and connected at a second end thereof to a first end of the length of a spark plug wire;

an elongated spark plug wire formed of copper or aluminum and connectable at a second end thereof to the spark source.

13. The improvement of claim 12, wherein:

said spark plug wire is formed of hollow tubing.

14. The improvement of claim 12, wherein:

said tubing has five (5) complete loops.

15. The improvement of claim 12, wherein:

said tubing has an inside diameter (I.D.) of at least about ⅙ and an outside diameter (O.D.) of at least about ⅜" and a wall thickness of about 1/32".

16. The improvement of claim 12, wherein:

said device is substantially coated with a non-conductive material.

17. The improvement of claim 15, wherein:

each said loop has an inside diameter (I.D.) of in the range of ⅛" to 5".

* * * * *